US010648658B1

(12) United States Patent
Yang et al.

(10) Patent No.: US 10,648,658 B1
(45) Date of Patent: May 12, 2020

(54) SALT LAMP WITH AUDIO ARRANGEMENT

(71) Applicant: Shenzhen Chenbei Technology Co., Ltd., Shenzhen OT (CN)

(72) Inventors: Lin Yang, Shenzhen (CN); Hai Yang, Shenzhen (CN)

( * ) Notice: Subject to any disclaimer, the term of this patent is extended or adjusted under 35 U.S.C. 154(b) by 0 days.

(21) Appl. No.: 16/369,352

(22) Filed: Mar. 29, 2019

(30) Foreign Application Priority Data

Oct. 23, 2018 (CN) ..... 2018 2 1714083 U

(51) Int. Cl.
*F21V 33/00* (2006.01)
*H04R 1/02* (2006.01)

(52) U.S. Cl.
CPC ..... *F21V 33/0056* (2013.01); *F21V 33/0064* (2013.01); *H04R 1/025* (2013.01)

(58) Field of Classification Search
None
See application file for complete search history.

(56) References Cited

U.S. PATENT DOCUMENTS 10,047,947 B1 * 8/2018 Yang ..... A61L 9/22
2005/0030747 A1 * 2/2005 Bogdal ..... A61L 9/03 362/253
2010/0260491 A1 * 10/2010 Pitz ..... A01M 1/2061 392/390
2013/0265743 A1 * 10/2013 Lee ..... F21V 33/0004 362/96

FOREIGN PATENT DOCUMENTS

CN 107631200 A * 1/2018

* cited by examiner

*Primary Examiner* — Britt D Hanley
(74) *Attorney, Agent, or Firm* — Tsz Lung Yeung

(57) ABSTRACT

A salt lamp includes a main housing having a receiving cavity, a lighting arrangement and an audio arrangement. The lighting arrangement is provided underneath the main housing for generating illumination toward the receiving cavity. The audio arrangement includes a first speaker assembly provided in the receiving cavity. The first speaker assembly includes a first acoustic chamber secured on a top portion of the main housing, a second acoustic chamber extended from the first acoustic chamber, and a speaker provided on the acoustic chamber and arranged to position adjacent to a plurality of through audio holes formed on the main housing. The salt lamp is arranged to deliver an optimal mix of negative ions, lighting effect and audible sound to ambient environment.

20 Claims, 5 Drawing Sheets

SALT LAMP WITH AUDIO ARRANGEMENT

BACKGROUND OF THE PRESENT INVENTION

Field of Invention

The present invention relates to a salt lamp, and more particularly to a salt lamp comprising an audio arrangement and a lighting arrangement which are capable of delivering an optimal mix of audio effect, light effect and negative ions to ambient environment.

Description of Related Arts

A conventional salt lamp may be equipped with illuminators or speakers so that when they are used to generate negative ions, some sorts of illumination or audible sound may also be generated. A major disadvantage is that the illuminators or speakers may easily be damaged by liquified residuals of salt crystal member so that the illuminators or the speakers do not have satisfactory product life. Moreover, the illuminators or the speakers present in conventional salt lamp can only product very simple illumination and music and do not necessarily match with the atmosphere in which the salt lamp is used.

As a result, there is a need to develop a salt lamp which may improve upon the above-mentioned conventional salt lamps and generate illumination and audible sound of better and more matching quality.

SUMMARY OF THE PRESENT INVENTION

Certain variations of the present invention provide a salt lamp comprising an audio arrangement and a lighting arrangement which are capable of delivering an optimal mix of audio effect, light effect and negative ions to ambient environment.

Certain variations of the present invention provide a salt lamp comprising an audio arrangement and a lighting arrangement, which are structurally protected from being damaged by salt crystal residuals so that the general lifespan of the salt lamp of the present invention may be prolonged as compared to conventional salt lamps.

Certain variations of the present invention provide a salt lamp comprising an audio arrangement which comprises a first acoustic chamber and a second acoustic chamber for producing audible sound of wider audible range as compared to conventional salt lamps. As a result, the audible sound so produced should be of better quality as compared to conventional salt lamps.

In one aspect of the present invention, it provides a salt lamp, comprising:

a main housing having a sidewall, a receiving cavity surrounded by the sidewall for storing a predetermined amount of salt crystal members, and a plurality of through audio holes formed on the sidewall;

a lighting arrangement provided underneath the main housing for generating illumination toward the receiving cavity, the illumination being arranged to heat up the salt crystal members to produce negative ions; and an audio arrangement which comprises a first speaker assembly provided in the receiving cavity of the main housing, the first speaker assembly comprising a first acoustic chamber secured on a top portion of the main housing, a second acoustic chamber extended from the first acoustic chamber, and a speaker provided on the acoustic chamber and arranged to position adjacent to the through audio holes of the main housing, wherein the salt lamp is arranged to deliver an optimal mix of negative ions, lighting effect and audible sound to ambient environment.

This summary presented above is provided merely to introduce certain concepts and not to identify any key or essential features of the claimed subject matter.

DETAILED DESCRIPTION OF THE PREFERRED EMBODIMENT

Figure 1:
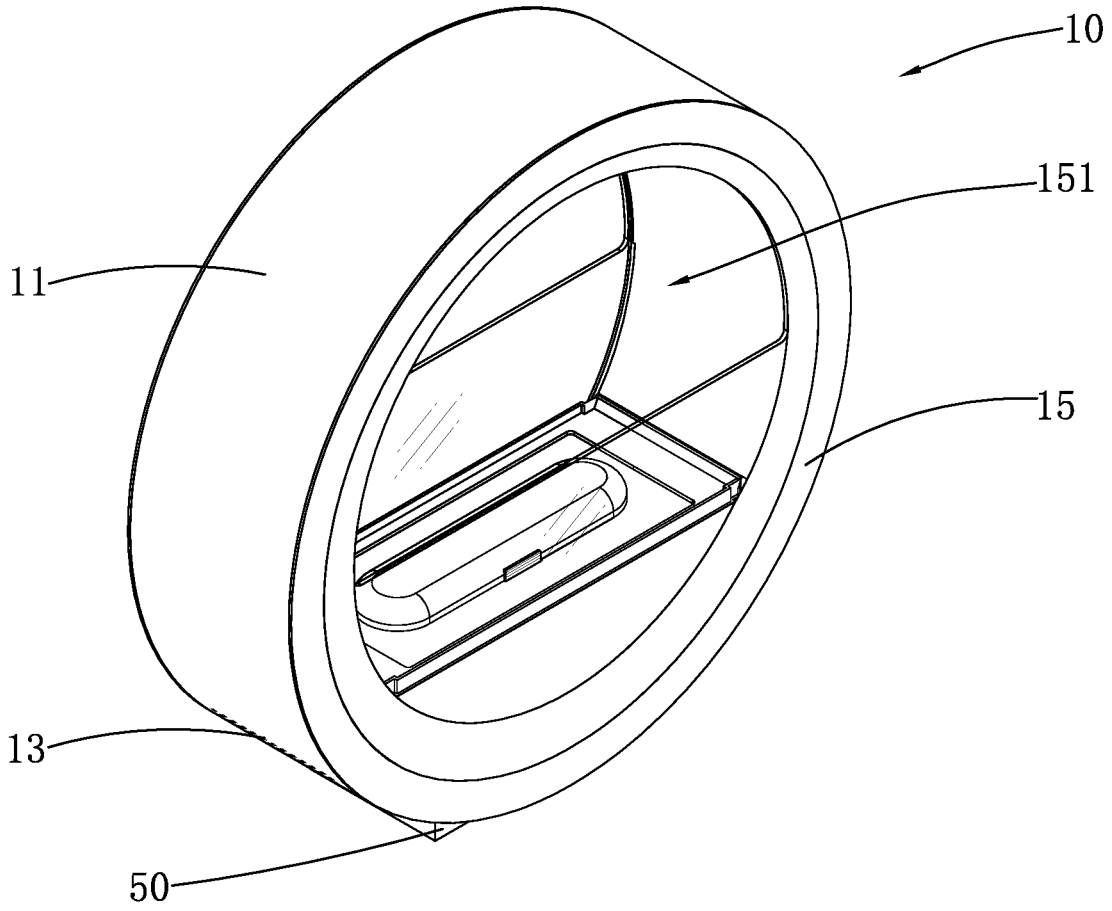
FIG. 1 is a perspective view of a salt lamp according to a preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIG. 1 to FIG. 5 of the drawings, a salt lamp according to a preferred embodiment of the present invention is illustrated. Broadly, the salt lamp may comprise a main housing 10, a lighting arrangement 20, and an audio arrangement 30. The salt lamp may be utilized to heat up a predetermined amount of salt crystal members 40 for generating negative ions in ambient air. The salt crystal members 40 may be in the form of salt crystals rocks.

The main housing 10 may have a sidewall 11, a receiving cavity 12 surrounded by the sidewall 11 for storing a predetermined amount of salt crystal members 40, and a plurality of through audio holes 13 formed on the sidewall 11.

The lighting arrangement 20 may be provided underneath the main housing 10 for generating illumination toward the receiving cavity 12. The illumination thus generated may be arranged to heat up the salt crystal members 40 to produce negative ions.

The audio arrangement 30 may comprise a first speaker assembly 31 provided in the receiving cavity 12 of the main housing 10. The first speaker assembly 31 may comprise a first acoustic chamber 311 secured on a top portion 14 of the main housing 10, a second acoustic chamber 312 extended from the first acoustic chamber 311, and a speaker 313 provided on the second acoustic chamber 312 and arranged to position adjacent to the through audio holes 13 of the main housing 10. The salt lamp of the present invention may be arranged to deliver an optimal mix of negative ions, lighting effect and audible sound to ambient environment.

According to the preferred embodiment of the present invention, the main housing 10 may be configured to have a circular cross-sectional shape when viewed from the front or from the rear, so that the main housing 10 may have only one circumferential sidewall 11. Other cross-sectional shapes of the main housing 10 are also possible, such as rectangular, square, triangular cross-sectional shape etc. The main housing 10 may further comprise a front panel 15 and a rear panel 16 provided on a front side and a rear side of the sidewall 11 to form a cylindrical structure of the main housing 10, wherein the receiving cavity 12 may be formed as a space surrounded by the sidewall 11, the front panel 11 and the rear panel 12. A front supporting ring 17 and a rear supporting ring 18 may be mounted to the front panel 15 and the rear panel 16 respectively for structurally reinforcing them. Accordingly, the front panel 15 and the rear panel 16 may be surrounded by the front supporting ring 17 and the rear supporting ring 18 respectively.

Figure 2:
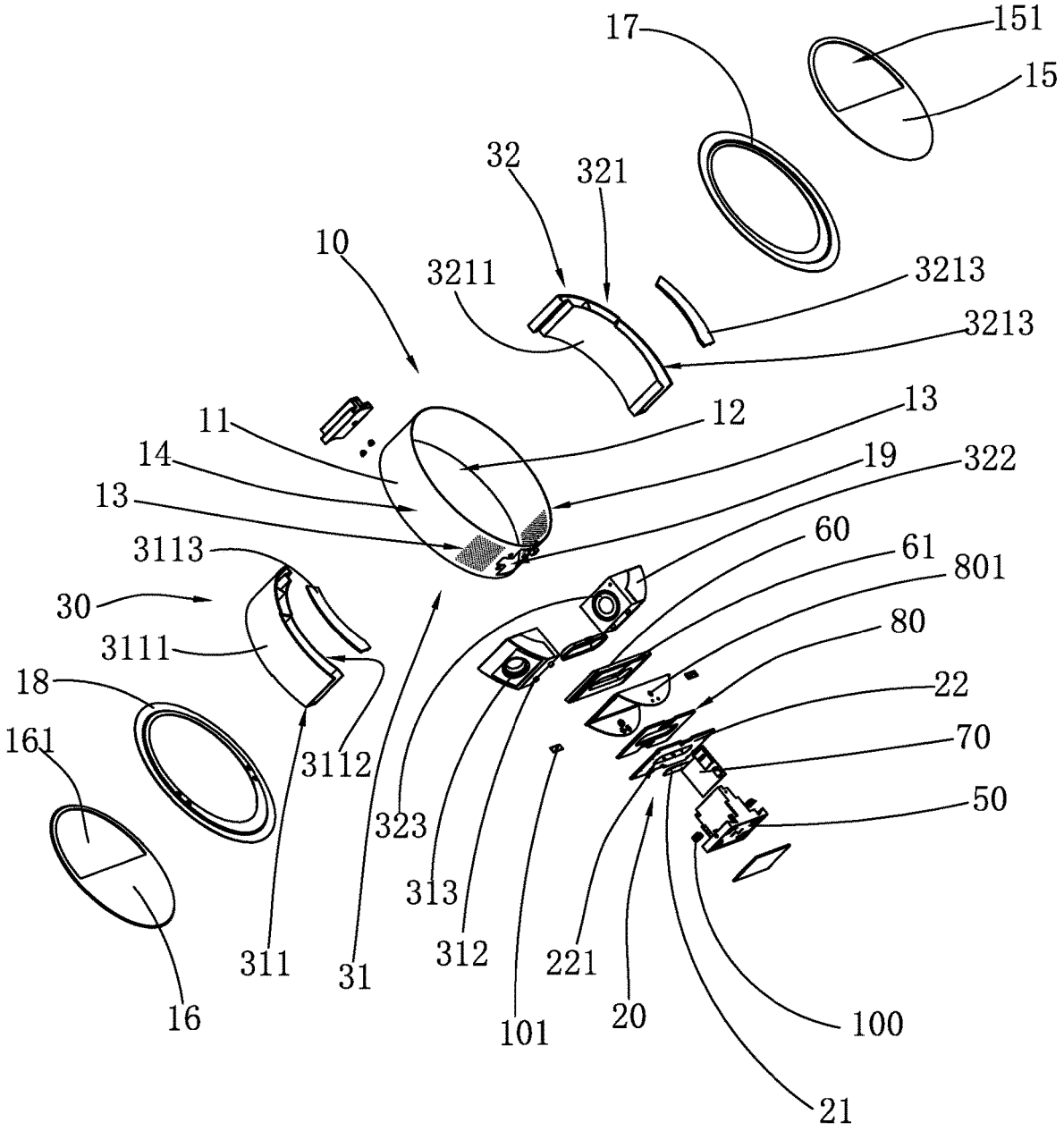
FIG. 2 is an exploded perspective view of the salt lamp according to the preferred embodiment of the present invention.
Figure 3:
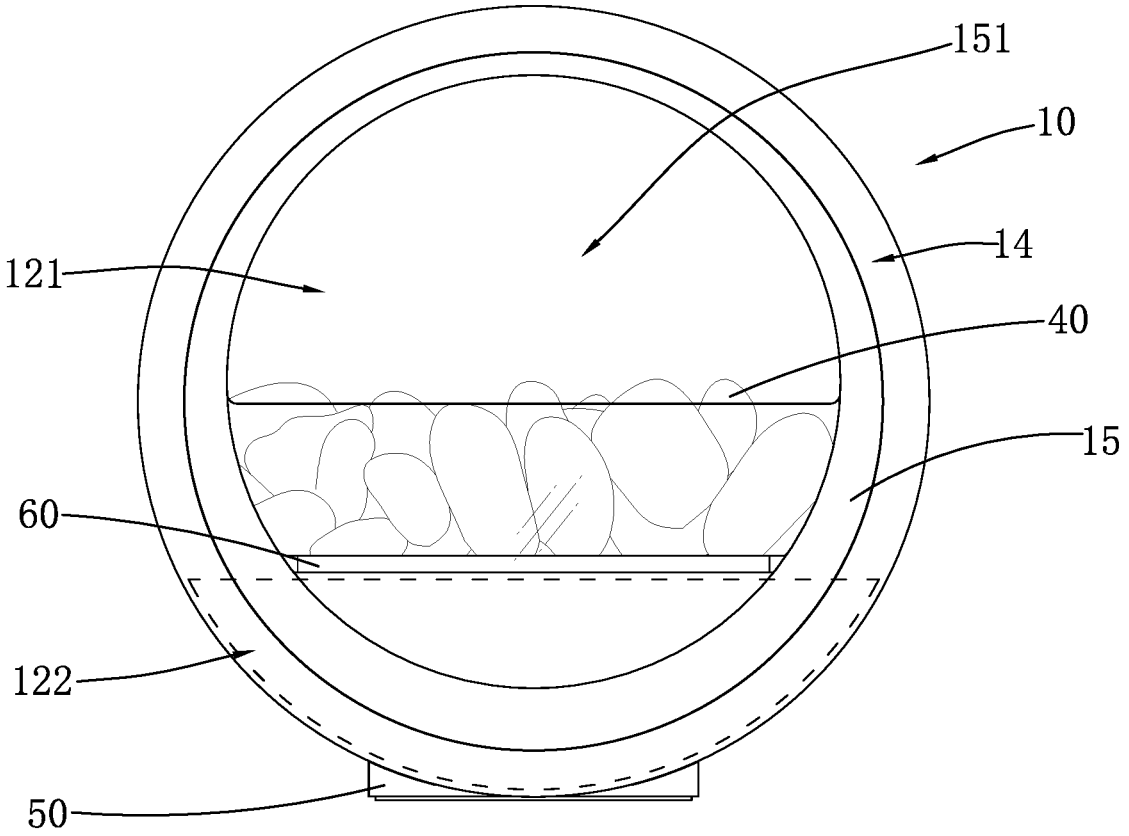
FIG. 3 is a schematic front view of the salt lamp according to the preferred embodiment of the present invention.

As shown in FIG. 2 of the drawings, the front panel 15 may have a front opening 151 communicating the receiving cavity 12 with an exterior of the main housing 10 from a front side thereof. Similarly, the rear panel 16 may have a rear opening 161 communicating the receiving cavity 12 with an exterior of the main housing 10 from a rear side thereof. The front opening 151 and the rear opening 161 may provide an access for a user to dispose and replace the salt crystal members 40 into or from the receiving cavity 12. A shape and size of each of the front opening 151 and the rear opening 161 may depend on manufacturing and aesthetic circumstances of the present invention. In this preferred embodiment, each of the front opening 151 and the rear opening 161 may have a substantially semi-circular cross-sectional shape. The radius of curvature of each of the front opening 151 and the rear opening 161 may correspond to that of the sidewall 11 of the main housing 10. The front opening 151 and the rear opening 161 may also provide a path for negative ions generated in the receiving cavity 12 to be distributed to ambient environment.

Each of the front panel 15 and the rear panel 16 may be configured by or made of light admissible material so that light from the illumination arrangement 20 may be delivered to ambient environment through the front panel 15 and the rear panel 16. An exemplary material is transparent plastic material or glass material.

The salt lamp of the present invention may further comprise a base 50 mounted on a bottom side of the main housing 10 such that the salt lamp may stand and be supported by the base 50. The base 50 may be configured as having a hollow structure for accommodating other components of the salt lamp of the present invention. The base 50 may communicate with the receiving cavity 12 of the main housing through a bottom opening 19 formed on the sidewall 11.

The salt lamp of the present invention may further comprise a salt residual collection tray 60 detachably mounted in the receiving cavity 12 to divide the receiving cavity 12 into an upper accommodating compartment 121 and a lower accommodating compartment 122. The upper accommodating compartment 121 is the space of the receiving cavity 12 above the salt residual collection tray 60. The lower accommodating compartment 121 is the space of the receiving cavity 12 below the salt residual collection tray 60. The upper accommodating compartment 121 may be utilized for accommodating the salt crystal members 40, while the lower accommodating compartment 122 may be utilized to accommodate the lighting arrangement 20, the audio arrangement 30 and other components of the salt lamp of the present invention.

When the salt crystal members 40 is heated up in the receiving cavity 12, residuals in the form of liquid may be collected in the salt residual collection tray 60. Thus, the salt residual collection tray 60 may have an indented portion to collect the liquid crystal residual.

The lighting arrangement 20 may comprise an illuminating module 21 mounted in the base 50 for providing illumination. The illuminating module 21 may comprise an illuminating circuitry 211 and at least one illuminator 212 connected to the illuminating circuitry 211. The illuminating circuitry 211 may be implemented on a Printed Circuit Board (PCB). The illuminator 212 may be configured as a LED for generating illumination mainly toward the receiving cavity 12 of the main housing 10.

The salt residual collection tray 60 may further have a light admissible panel 61 configured to have a predetermined light admissibility and positioned to correspond to or align with the illuminator 212 so that the illumination generated by the illuminator 212 may reach the receiving cavity through the light admissible panel 61.

As shown in FIG. 2 of the drawings, the salt lamp may further comprise a main control circuitry 70 received in the lower accommodating compartment 121 of the receiving cavity 12 and electrically connected to the acoustic arrangement 30 and the lighting arrangement 20 for controlling an operation of these elements. The main control circuitry 70 may also be implemented on a Printed Circuit Board (PCB) which may or may not be integrated with the PCB of the illuminating circuitry 211. The main control circuitry 70 may thus be electrically connected to the illuminating circuitry 211 so as to control an operation thereof for controlling the illumination generated by the illuminator 212.

The lighting arrangement 20 may further comprise a securing member 22 mounted below the salt residual collection tray 60 for securing the illuminating module 21. Specifically, the securing member 22 may be configured as a panel-like structure which may be mounted at a position between the salt residual collection tray 60 and the main control circuitry 70. The illuminating module 21 may be secured on a bottom surface of the securing member 22. The securing member 22 may have a light admissible portion 221 so that the illumination generated by the illuminating module 21 may pass through the securing member 22 and eventually reach the upper accommodating 121 of the receiving cavity 12. In this preferred embodiment, the light admissible portion 221 may be a slightly protruded portion and the illuminator 212 may be provided underneath the light admissible portion 221. It is worth mentioning that the securing member 22 may be entirely made of light admissible material and coated with light inadmissible coating except on the light admissible portion 221. This configuration ensures that the light generated by the illuminator 212 may reach the upper accommodating compartment 121 of the receiving cavity 12 while at the same time prevent light from leaking out from other parts of the main body 10.

The acoustic arrangement 30 may further comprise a second speaker assembly 32 accommodated in the lower accommodating compartment 121 of the receiving cavity and electrically connected to the main control circuitry 70. The second speaker assembly 32 may be structurally identical to the first speaker assembly 31 described above. Specifically, the second speaker assembly 32 may comprise a third acoustic chamber 321 secured on a top portion 14 of the main housing 10, a fourth acoustic chamber 322 extended from the third acoustic chamber 321, and a second speaker 323 provided on the fourth acoustic chamber 312 and arranged to position adjacent to the through corresponding audio holes 13 of the main housing 10.

As shown in FIG. 1 and FIG. 2 of the drawings, the first speaker assembly 31 and the second speaker assembly 32 may be provided on two opposed sides of the main housing 10 respectively. The first acoustic chamber 311 and the third acoustic chamber 321 may be provided on two opposed sides on the top portion 14 of the main housing 10 respectively and in the upper accommodating compartment 121 of the receiving cavity 12. On the other hand, the second acoustic chamber 312 and the fourth acoustic chamber 322 may be provided on opposed sides on the bottom portion 140 of the main housing 10 respectively and in the lower accommodating compartment 122 of the receiving cavity 12.

Accordingly, a number of audio holes 13 may be formed on two sides of the lower portion 140 of the main housing 10 (on the sidewall 11) respectively at a position corresponding to the first speaker 313 and the second speaker 323. Thus, the audible sound generated by the first speaker 313 and the second speaker 323 may be delivered to the ambient environment through the audio holes 13.

Each of the first acoustic chamber 311 and the third acoustic chamber 321 may have a curved and elongated structure so as to fit the circumferential contours of the sidewall 11 of the main housing 10. The first acoustic chamber 311 and the third acoustic chamber 321 may be mounted on two opposed inner surfaces of the sidewall 11 respectively in which a radius of curvature of each of the first acoustic chamber 311 and the third acoustic chamber 321 may correspond to the radius of curvature of the sidewall 11.

On the other hand, the second acoustic chamber 312 and the fourth acoustic chamber 322 may extend from the first acoustic chamber 311 and the third acoustic chamber 321 respectively in the receiving cavity 12. In this preferred embodiment, the second acoustic chamber 322 and the fourth acoustic chamber may be secured in the lower accommodating compartment 122 of the receiving cavity 12. The first through fourth acoustic chambers 311, 312, 321, 322 may provide specific acoustic effect to enhance the quality of the audible sound delivered by the first speaker 313 and the second speaker 323. The first speaker assembly 31 and the second speaker assembly 32 may be mounted in the receiving cavity 12 in a symmetrical configuration.

The first acoustic chamber 311 may comprise a first chamber body 3111 having a first body opening 3112, and a first chamber cover 3113 provided on the first chamber body 3111 for covering the first body opening 3112 so as to seal the first chamber body 3111. The reason for having this construction is for ease of manufacturing. The first chamber body 3111 and the first chamber cover 3113 may be individually manufactured so as to minimize manufacturing defects of the entire first acoustic chamber 311.

This is the same as for the third acoustic chamber 321. Thus, the third acoustic chamber 321 may comprise a third chamber body 3211 having a third body opening 3212, and a third chamber cover 3213 provided on the third chamber body 3111 for covering the third body opening 3212 so as to seal the third chamber body 3211.

The salt lamp of the present invention may further comprise a heating module 80 provided underneath the salt residual collection tray 60 and electrically connected to the main control circuitry 70. The heating module 80 may be controlled by the main control circuitry 70 and may be arranged to generate heat for heating up the salt residual collection tray 60. The salt residual collection tray 60 may be in direct contact with the salt crystal members 40 so that when the salt residual collection tray 60 is heated up, the salt crystal members 40 may also be heated up to release negative ions to ambient environment. Liquid residuals may then be collected in the salt residual collection tray 60. When the salt residual collection tray 60 has become full, it may be easily detached from the receiving cavity 12 for cleaning.

The heating module 80 may comprise a heat pad 81 and a heating element 82 embedded in the heat pad 81 and electrically connected to the main control circuitry 70. The heat pad 81 may be configured from soft and flexible material for conducting a predetermined amount of heat to the residual collection tray 60 when the heating element 82 is being heated up. The heating module 80 may be mounted on top of the illuminating module 21. The heat pad 81 may have a through opening 811 positioned to correspond to the position of the illuminator 212 of the illuminating module 21. Moreover, the position of the through opening 811 may also correspond to the lighting admissible panel 61 of the salt residual collection tray 60 so that the illumination generated by the illuminator 212 may be able to eventually reach the receiving cavity 12 by passing through the through opening 811 of the heat pad 81 and the lighting admissible panel 61 of the salt residual collection tray 60.

Figure 4:
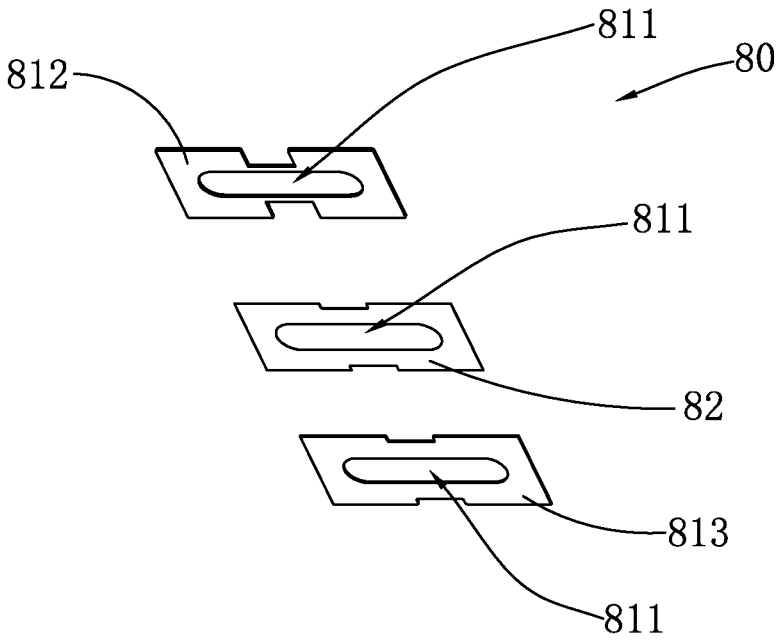
FIG. 4 is a schematic diagram of a heating module of the salt lamp according to the preferred embodiment of the present invention.
Figure 5:
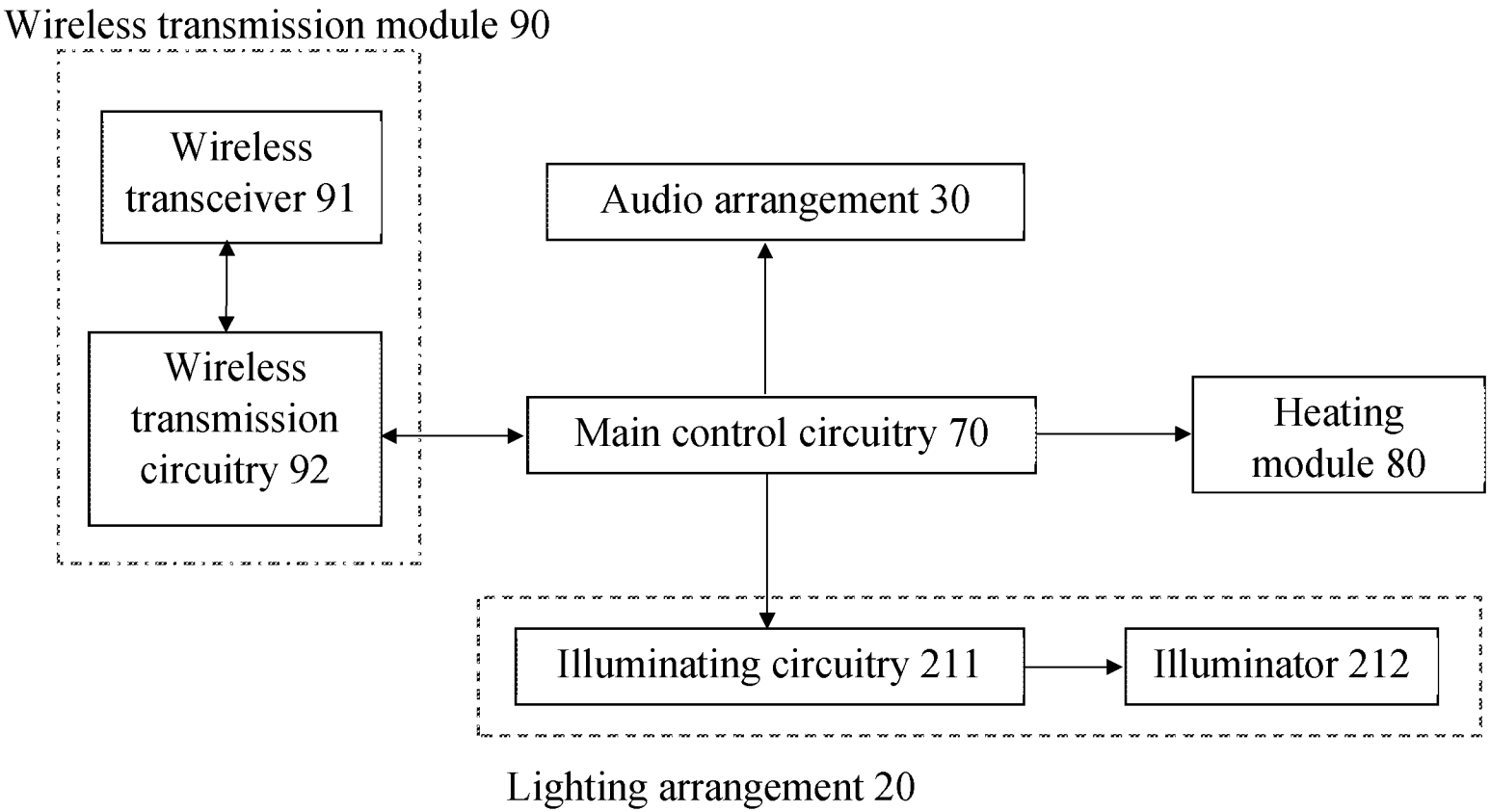
FIG. 5 is a block diagram of the electrical connection of the salt lamp according to the preferred embodiment of the present invention.

As shown in FIG. 4 of the drawings, the heat pad 81 may comprise an upper layer 812 and a lower layer 813, wherein the heating element 82 may be sandwiched between the upper layer 812 and the lower layer 813. In this preferred embodiment, the upper layer 812 may be configured from or made of thermally conductive silicone rubber, while the lower layer 813 may be configured from or made of thermally insulating silicone rubber. Thus, heat generated by the heating element may only be transferred toward the salt residual collection tray 60.

In this preferred embodiment of the present invention, the heating module 80 may be provided on top of the securing member 22 of the lighting arrangement 20 so that the securing member 22 may structurally reinforce the heat pad 81 while at the same time allowing illumination to reach the upper accommodating compartment 121 of the receiving cavity 12.

It is worth mentioning that the heat pad 81 and the salt residual collection tray 60 may be thermally communicated so that the heat generated by the heat pad 81 may be transferred to the salt residual collection tray 60, which may be made of thermal conductive material. The heat thus generated may be used to heat up the salt crystal members 40. In addition, when liquid residual is formed in the salt residual collection tray 60, the heat thus generated may also help in evaporating the liquid residual.

The salt lamp of the present invention may further comprise a pressing member 801 mounted underneath the salt residual collection tray 60 for pressing against the heat pad 81 of the heating module 80. Thus, the heat pad 81 may be sandwiched between the pressing member 801 and the securing member 22. In this preferred embodiment, the pressing member 801 may be configured as a panel-like structure and may be made of light admissible or at least have a light admissible portion so that the heat from the heat pad 81 may be transferred to the salt residual collection tray 60. Moreover, the light generated by the illuminating arrangement 20 may also reach the upper accommodating compartment 121 of the receiving cavity 12 through the pressing member 801.

The salt lamp of the present invention may further comprise a wireless transmission module 90 provided in the main body 10 and electrically connected to the main control circuitry 70 for transmitting and receiving wireless signal to and from an external device. The wireless transmission module 90 may comprise a wireless transceiver 91 and a wireless transmission circuitry 92 provided in the receiving cavity 12 of the main body 10 and electrically connected to the main control circuitry 70. The wireless transceiver 91 may be configured to receiver and transmit short-range wireless communication protocols such as BLUETOOTH wireless technology for connecting the salt lamp with other external devices, such as a smartphone. The wireless transmission circuitry 92 may be incorporated into the main control circuitry 70 or configured as a separate circuitry provided in the receiving cavity 12.

The salt lamp may further comprise a control panel 100 and at least one indicator 101 provided on at least one of the main body 10 and the base 50 and electrically connected to the main control circuitry 70 and the wireless transmission module 90 for allowing a user to control an operation of the salt lamp through operating on the control panel 100.

The operation of the present invention may be as follows: a user may manually place a predetermined amount of salt crystal members 40 in the upper accommodating compartment 121 of the receiving cavity 12. After that, the user may operate on the control panel 100 to start heating up the salt crystal members 40 and turn on the illuminating arrangement 20 and/or the audio arrangement 30. The illumination and the audible sound may be programmed to match with generating negative ions by the salt crystal members 40 so as to accomplish an optimal mix of audio and illuminating effect. The quality of the audible sound produced by the present invention may be substantially enhanced as compared to conventional arts because of the first through fourth acoustic chambers 311, 312, 321, 322 as described above.

The present invention, while illustrated and described in terms of a preferred embodiment and several alternatives, is not limited to the particular description contained in this specification. Additional alternative or equivalent components could also be used to practice the present invention.

What is claimed is:

1. A salt lamp, comprising:

a main housing having a sidewall, a receiving cavity surrounded by said sidewall for storing a predetermined amount of salt crystal members, and a plurality of through audio holes formed on said sidewall;

a lighting arrangement provided underneath said main housing for generating illumination toward said receiving cavity, said illumination being arranged to heat up said salt crystal members to produce negative ions; and an audio arrangement which comprises a first speaker assembly provided in said receiving cavity of said main housing, said first speaker assembly comprising a first acoustic chamber secured on a top portion of said main housing, a second acoustic chamber extended from said first acoustic chamber, and a speaker provided on said acoustic chamber and arranged to position adjacent to said through audio holes of said main housing, wherein said salt lamp is arranged to deliver a mix of negative ions, lighting effect and audible sound to ambient environment.

2. The salt lamp, as recited in claim 1, wherein said main housing comprises a circumferential sidewall, a front panel and a rear panel provided on a front side and a rear side of said circumferential sidewall to form a cylindrical structure of said main housing, wherein said receiving cavity is formed as a space surrounded by said circumferential sidewall, said front panel and said rear panel.

3. The salt lamp, as recited in claim 2, further comprising a salt residual collection tray detachably mounted in said receiving cavity to divide said receiving cavity into an upper accommodating compartment and a lower accommodating compartment, said upper accommodating compartment being a space of said receiving cavity above said salt residual collection tray, said lower accommodating compartment being a space of said receiving cavity below said salt residual collection tray.

4. The salt lamp, as recited in claim 3, wherein said acoustic arrangement further comprises a second speaker assembly accommodated in said lower accommodating compartment of said receiving cavity and electrically connected to said main control circuitry, said second speaker assembly comprising a third acoustic chamber secured on a top portion of said main housing, a fourth acoustic chamber extended from said third acoustic chamber, and a second speaker provided on said fourth acoustic chamber and arranged to position adjacent to said through corresponding audio holes of said main housing.

5. The salt lamp, as recited in claim 4, wherein said first speaker assembly and said second speaker assembly are provided on two opposed sides of said main housing respectively.

6. The salt lamp, as recited in claim 5, wherein each of said first acoustic chamber and said third acoustic chamber is a curved and elongated structure so as to fit a circumferential contour of said sidewall of said main housing, said first acoustic chamber and said third acoustic chamber being mounted on two opposed inner surfaces of said sidewall respectively in said upper accommodating compartment, while said second acoustic chamber and said fourth acoustic chamber extending from said first acoustic chamber and said third acoustic chamber respective and being secured in said lower accommodating compartment of said receiving cavity.

7. The salt lamp, as recited in claim 6, wherein said first acoustic chamber comprises a first chamber body having a first body opening, and a first chamber cover provided on said first chamber body for covering said first body opening so as to seal said first chamber body.

8. The salt lamp, as recited in claim 7, wherein said third acoustic chamber comprises a third chamber body having a third body opening, and a third chamber cover provided on said third chamber body for covering said third body opening so as to seal said third chamber body.

9. The salt lamp, as recited in claim 8, further comprising a base mounted on a bottom side of said main housing and communicate with said receiving cavity of said main housing, said lighting arrangement comprising an illuminating module mounted in said base for providing illumination, said illuminating module comprising an illuminating circuitry and at least one illuminator connected to said illuminating circuitry.

10. The salt lamp, as recited in claim 9, wherein said salt residual collection tray further has a light admissible panel configured to have a predetermined light admissibility and positioned to correspond to said illuminator so that said illumination generated by said illuminator is capable of reaching said receiving cavity through said light admissible panel.

11. The salt lamp, as recited in claim 10, further comprising a main control circuitry received in said lower accommodating compartment of said receiving cavity and electrically connected to said acoustic arrangement and said lighting arrangement for controlling an operation of said acoustic arrangement and said lighting arrangement.

12. The salt lamp, as recited in claim 11, further comprising a heating module provided underneath said salt residual collection tray and electrically connected to said main control circuitry, said heating module being controlled by said main control circuitry and being arranged to generate heat for heating up said salt residual collection tray.

13. The salt lamp, as recited in claim 12, wherein said heating module comprises a heat pad and a heating element embedded in said heat pad and electrically connected to said main control circuitry, said heating module being mounted on top of said illuminating module, and has a through opening positioned to correspond to a position of said illuminator of said illuminating module and said lighting admissible panel of said salt residual collection tray.

14. The salt lamp, as recited in claim 8, wherein said front panel has a front opening communicating said receiving cavity with an exterior of said main housing from a front side thereof.

15. The salt lamp, as recited in claim 13, wherein said front panel has a front opening communicating said receiving cavity with an exterior of said main housing from a front side thereof.

16. The salt lamp, as recited in claim 14, wherein said rear panel has a rear opening communicating said receiving cavity with an exterior of said main housing from a rear side thereof.

17. The salt lamp, as recited in claim 15, wherein said rear panel has a rear opening communicating said receiving cavity with an exterior of said main housing from a rear side thereof.

18. The salt lamp, as recited in claim 2, wherein each of said front panel and said rear panel is configured from light admissible material.

19. The salt lamp, as recited in claim 15, wherein each of said front panel and said rear panel is configured from light admissible material.

20. The salt lamp, as recited in claim 17, wherein each of said front panel and said rear panel is configured from light admissible material.

* * * * *